US010049614B2

(12) United States Patent
Peana et al.

(10) Patent No.: US 10,049,614 B2
(45) Date of Patent: Aug. 14, 2018

(54) OLED DEGRADATION COMPENSATION SYSTEM

(71) Applicant: Dell Products L.P., Round Rock, TX (US)

(72) Inventors: Stefan Peana, Austin, TX (US); Jace Files, Round Rock, TX (US); Kenneth W. Stufflebeam, Jr., Georgetown, TX (US)

(73) Assignee: Dell Products L.P., Round Rock, TX (US)

( * ) Notice: Subject to any disclaimer, the term of this patent is extended or adjusted under 35 U.S.C. 154(b) by 1 day.

(21) Appl. No.: 14/925,687

(22) Filed: Oct. 28, 2015

(65) Prior Publication Data

US 2017/0124943 A1 May 4, 2017

(51) Int. Cl.
*G09G 3/3225* (2016.01)
*G09G 3/20* (2006.01)

(52) U.S. Cl.
CPC ... *G09G 3/3225* (2013.01); *G09G 2320/0233* (2013.01); *G09G 2320/0285* (2013.01); *G09G 2320/045* (2013.01); *G09G 2320/048* (2013.01); *G09G 2320/0626* (2013.01); *G09G 2320/0666* (2013.01); *G09G 2320/0693* (2013.01); *G09G 2360/144* (2013.01)

(58) Field of Classification Search
CPC .. G09G 3/3225; G09G 3/2003; G09G 3/2007; G09G 2320/0233; G09G 2320/048; G09G 2320/0626; G09G 2360/144
See application file for complete search history.

(56) References Cited

U.S. PATENT DOCUMENTS

2007/0001940 A1* 1/2007 Jo ..... G09G 3/2014 345/77
2016/0104411 A1* 4/2016 Nathan ..... G09G 3/2007 345/690

* cited by examiner

*Primary Examiner* — Charles Hicks
(74) *Attorney, Agent, or Firm* — Haynes and Boone, LLP

(57) ABSTRACT

An OLED degradation compensation system includes a display system having an OLED display device. A computing device is coupled to the display system and includes an OLED display device adjustment database storing an OLED table that is associated with a usage time of the OLED display device and that includes OLED compensation information that is based upon the usage time. An OLED display device use tracking engine in the computing system determines usage data for the OLED display device. An OLED display device adjustment engine in the computing system retrieves the usage data determined by the OLED display device use tracking engine, uses the usage data to select the OLED table in response to the usage data corresponding to the usage time associated with the OLED table, and causes at least one OLED in the OLED display device to be powered using the OLED compensation information in the OLED table.

20 Claims, 6 Drawing Sheets

OLED DEGRADATION COMPENSATION SYSTEM

BACKGROUND

The present disclosure relates generally to information handling systems, and more particularly to an information handling system that provides for the compensation of Organic Light Emitting Diode (OLED) degradation.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Some information handling systems such, as, for example, desktop computers, laptop/notebook computers, tablet computers, mobile phones, televisions, and/or other computing systems known in the art are beginning to utilize Organic Light Emitting Diode (OLED) display devices for displaying information generated by the computing device. OLED display devices are desirable due to their wider color gamut and thinner/lighter structure as compared to conventional display technologies, characteristics that are particularly beneficial to mobile computing systems such as the laptop/notebook computers, tablet computers, and mobile phones discussed above. However, OLED display devices suffer from issues that have impeded their implementation in computing systems. For example, because OLEDs utilize organic materials that emit light in response to an applied current and/or voltage, OLEDs degrade over time as they're used. Furthermore, OLEDs that emit different colors (e.g., red, blue, and green) have been found to have different degradation profiles (e.g., blue emitting OLEDs degrade relatively faster than red and green emitting OLEDs). As such, as OLED display devices age, the image quality is affected due to the different degradations in the blue, red, and green emitting OLEDs.

Conventional systems for dealing with OLED degradation typically involve compensation circuits that monitor the current, voltage, or combinations thereof into and out of the OLED to determine the color being produced by that OLED, and then adjust the current, voltage, or combinations thereof into the OLED to produce a desired color (determined based on a desired output current, voltage, or combinations thereof). For example, in such conventional systems the current to a blue emitting OLED in a pixel may be increased to modified the color emitted by that blue emitting OLED in order to maintain a desired color of that pixel that has changed due to the degradation of the blue emitting OLED. However, the increasing of the current to that blue emitting OLED operates to accelerate the degradation of that blue emitting OLED. In another example, the current to a red emitting OLED and/or green emitting OLED in a pixel may be decreased to modify the color emitted by that red emitting OLED and/or green emitting OLED to maintain a desired color of that pixel that has changed due to the degradation of the blue emitting OLED. However, the decreasing of the current to that red emitting OLED and/or green emitting OLED operates to decrease the brightness of that pixel.

Accordingly, it would be desirable to provide an improved OLED degradation compensation system.

SUMMARY

According to one embodiment, an information handling system (IHS) includes a display device connector that is configured to couple to an Organic Light Emitting Diode (OLED) display device; a storage system storing an OLED table that is associated with a usage time of the OLED display device and that includes OLED compensation information that is based upon the usage time; a processing system coupled to the storage system and the display device connector; and a memory system coupling to the processing system and including instructions that, when executed by the processing system, cause the processing system to provide an OLED degradation compensation engine that is configured to: determine usage data for the OLED display device; select the OLED table in the storage system in response to the usage data corresponding to the usage time associated with the OLED table; and cause at least one OLED in the OLED display device to be powered using the OLED compensation information in the OLED table.

DETAILED DESCRIPTION

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 1:
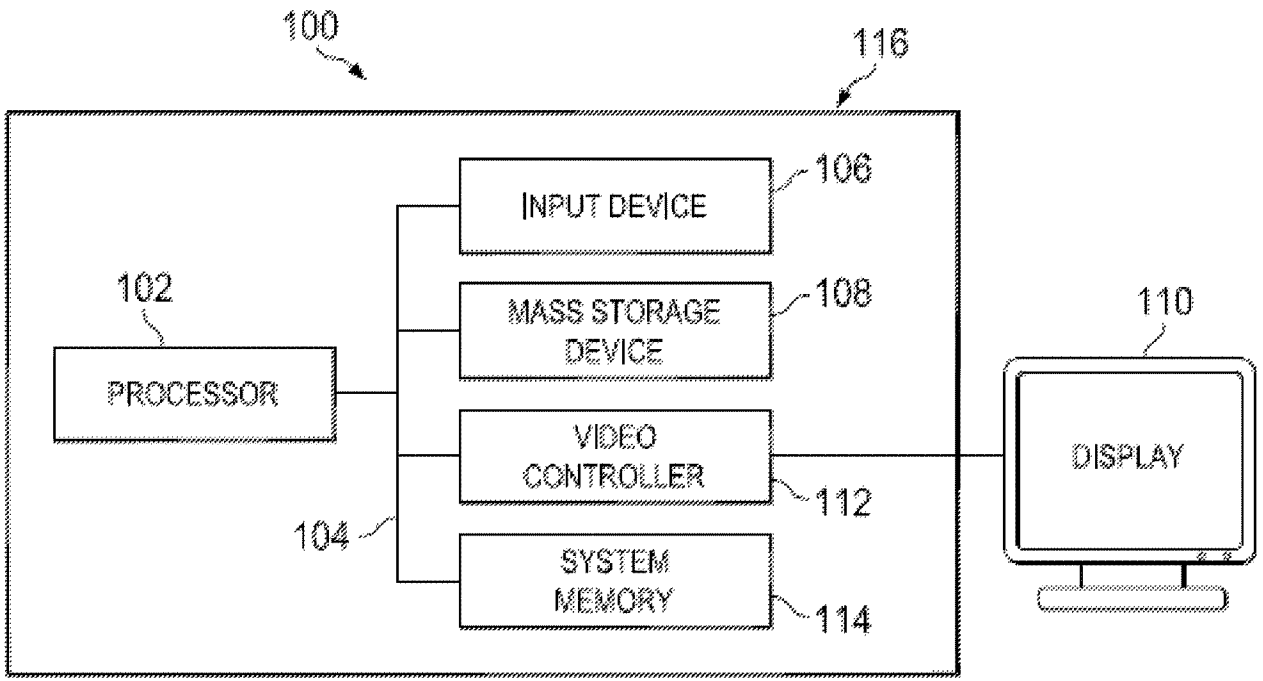
FIG. 1 is a schematic view illustrating an embodiment of an information handling system.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2:
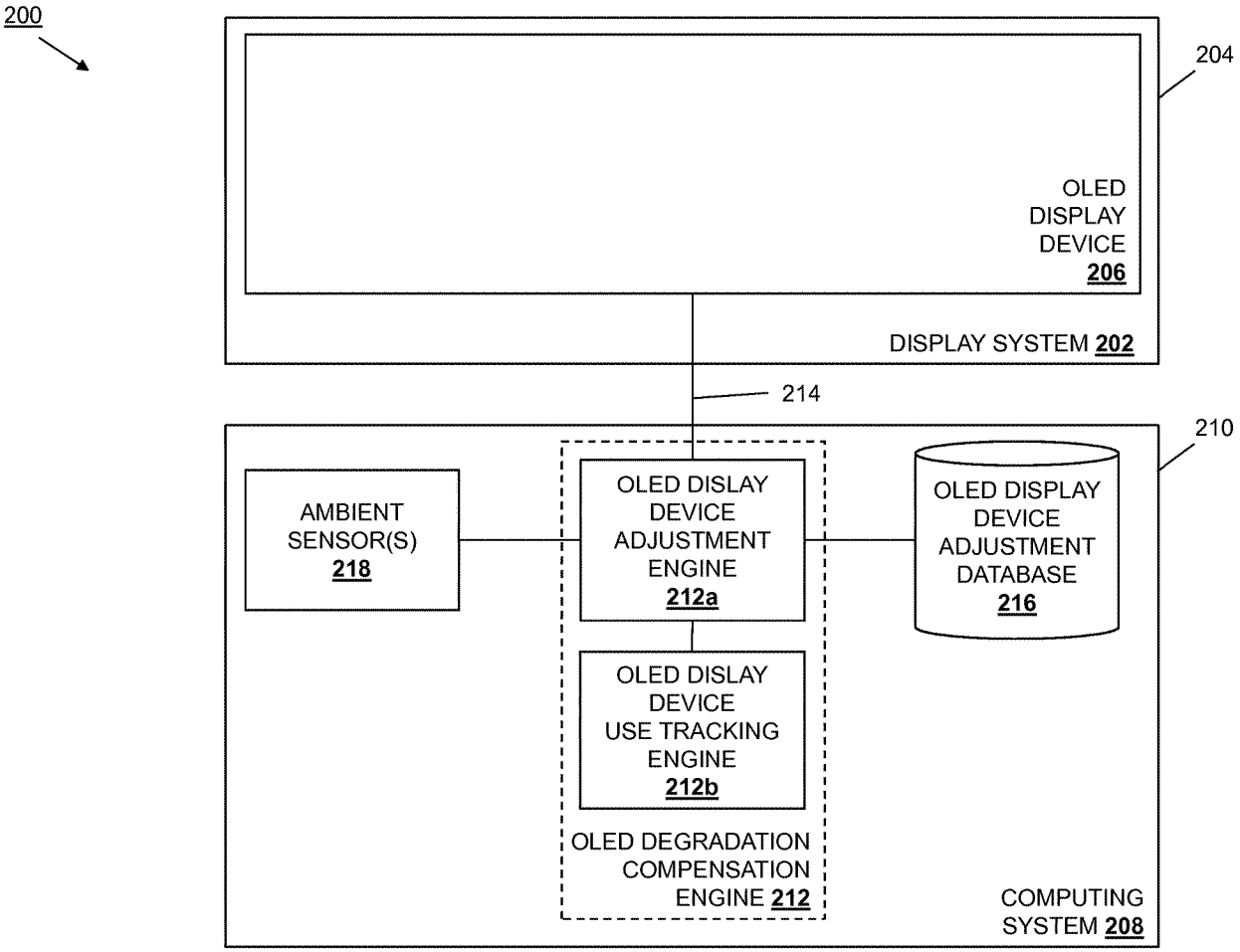
FIG. 2 is a schematic view illustrating an embodiment of an OLED degradation compensation system.

Referring now to FIG. 2, an embodiment of an Organic Light Emitting Diode (OLED) degradation compensation system 200 is illustrated. The OLED degradation compensation system 200 includes a display system 202 having a chassis 204 that houses an OLED display device 206 (as well as other components of the display system 202 that have not been illustrated for clarity). In an embodiment, the display system 202 may be the IHS 100 discussed above with reference to FIG. 1 and/or may include some or all of the components of the IHS 100. In some embodiments, the display system 202 may be a standalone display system such that the chassis 204 includes connectors that are coupled to the OLED display device 206 and that are configured to couple to the computing systems discussed below. However, in other embodiments, the display system 202 may be integrated with the computing systems discussed below such that the chassis 202 may be a portion of a chassis that houses the OLED display device 206 and the components of the computing system. In an embodiment, the OLED display device 206 includes a plurality of OLEDs that are configured to emit different colors. In the examples below, OLEDs that emit blue, red, and green are discussed. However, one of skill in the art in possession of the present disclosure will recognize that OLEDs that emit other colors such as yellow, magenta, and cyan will fall within the scope of the present disclosure, and that the teachings of the present disclosure will be beneficial for any OLEDs that emit any color of the electromagnetic spectrum.

While not illustrated, one of skill in the possession of the present disclosure will recognize that the OLEDs in the OLED display device 206 may include an emissive layer and a conductive layer provided between an cathode and an anode that are further provided between a seal and a substrate. The organic material provided in the emissive layer may be selected to emit a desired color when a voltage is provided across the anode and the cathode. Furthermore, each pixel in the OLED display device 206 may include a plurality of OLED sub-pixels such as, for example, a blue emitting OLED, a red emitting OLED, and a green emitting OLED that may be powered as discussed above to cause the pixel to emit a desired color at a desired brightness. In different embodiments, the OLED sub-pixels may be positioned side-by-side, one top of each other, and/or in a variety of different orientations depending on the desired OLED/pixel density. While a specific OLED display device has been described, one of skill in the art in possession of the present disclosure will recognize that any of a variety of OLED display devices will fall within the scope of the present disclosure.

The OLED degradation system 200 also includes a computing system 208. In an embodiment, the computing system 208 may be the IHS 100 discussed above with reference to FIG. 1 and/or may include some or all of the components of the IHS 100. The computing system includes a chassis 210 that houses the components of the computing system 208, only some of which have been illustrated for clarity. Similarly as discussed above, in some embodiments, the computing system 208 may be a standalone computing system such that the chassis 210 includes connectors that are configured to couple to the display systems discussed above and below. However, in other embodiments, the computing system 208 may be integrated with the display systems discussed below such that the chassis 210 may be a portion of a chassis that houses the OLED display device 206 and the components of the computing system. In the illustrated embodiment, the chassis 210 may house a processing system (not illustrated, but which may include the processor 102 discussed above with reference to FIG. 1) and a memory system (not illustrated, but which may include the system memory 114 discussed above with reference to FIG. 1) that includes instructions that, when executed by the processing system, cause the processing system to provide an OLED degradation compensation engine 212 that is configured to perform the functions of the OLED degradation compensation engines and computing systems discussed below.

In a specific embodiment, the OLED degradation compensation engine 212 includes an OLED display device adjustment engine 212*a* and an OLED display device use tracking engine 212*b*. In some of the examples discussed below, the OLED display device adjustment engine 212*a* may be provided, at least in part, by a Graphics Processing Unit (GPU) executing instructions included on the memory system, while the OLED display device use tracking engine 212*b* may be provided, at least in part, by a Basic Input/Output System (BIOS), a video driver, and/or a variety of other hardware/software engine components known in the art. In a specific example, the GPU and the BIOS may be coupled together by a bus in the computing system 208 and may operate together to provide the OLED degradation compensation engine 212. However, while the OLED display device adjustment engine 212*a* and an OLED display device use tracking engine 212*b* are described as separate engines enabled by separate components in the computing system 208, they may be combined as the OLED degradation compensation engine 212 and enabled by a single component in the computing system 208, or enabled by additional components provided in the computing system 208, while remaining within the scope of the present disclosure.

The OLED degradation compensation engine 212 (and specifically the OLED display device adjustment engine 212*a* in the illustrated embodiment) is coupled to the OLED display device 206. In an embodiment, a display device connection 214 may be provided between the OLED degradation compensation engine 212 and the OLED display device 206. For example, the display device connection 214 may be provided between an internal display device connector coupled to the processing system (e.g., a GPU) that provides the OLED display device adjustment engine 212*a*, and a processing system connector coupled to the OLED display device 206. In another example, the display device connection 214 may be provided between an external display device connector located on the chassis 210, and a computing system connector located on the chassis 204. However, any of a variety of connections and couplings between the OLED degradation compensation engine 212 and the OLED display device 206 are envisioned as falling within the scope of the present disclosure.

The chassis 210 may also house a storage system (not illustrated, but which may include the storage device 108 discussed above with reference to FIG. 1) that is coupled to the OLED degradation compensation engine 212 (e.g., via a coupling between the processing system and the storage system) and that includes an OLED display device adjustment database 216 that house one or more OLED tables, discussed in further detail below. In specific embodiments, the OLED device adjustment engine 212*a* and the OLED display device adjustment database 216 may include eeColor subsystems and/or eeColor algorithms available from Entertainment Experience, LLC of Reno, Nev. For example, eeColor subsystems and/or eeColor algorithms may include an eeColor Graphical User Interface (GUI) that is configured to allow a user to select and adjust parameters (or select an auto-mode that uses predefined parameters) such as vibrancy, color temperature, skin tone, and/or other display parameters known in the art; an eeColor Dynamic Link Library (DLL) plug-in that is configured to allow a user to create (or select an auto-mode that uses predefined parameters to provide) custom shaders based on ambient light conditions (e.g., brightness and/or color temperature), display system parameters, GUI settings, and/or other OLED display device characteristics.

In the illustrated embodiment, the chassis 210 also houses and/or includes one or more ambient sensor(s) 218 that are coupled to the OLED degradation compensation engine 212 (e.g., via a coupling between the ambient sensor(s) and the processing system) and that are configured to detect and report ambient conditions to the OLED degradation compensation engine 212. For example, the ambient sensor(s) 218 may include light sensors configured to detect and report ambient light conditions, cameras configured to detect and report user characteristics, and/or a variety of other ambient sensors known in the art. In an embodiment, the ambient sensor(s) 218 may be provided by or with an embedded controller. In a specific example, that embedded controller may be coupled to the eeColor subsystems and/or algorithms discussed above through a Dynamic Power and Performance (DPP) manager that monitors, captures, and supplies information on different chipset functions, and that may be configured to interface with drivers and other software such as a sensor array hub, frame buffers, video drivers, and/or other components to transmit display system parameters, provide notifications of ambient changes, get and compile shaders, perform validation and/or certification operations, update image buffers, and/or perform a variety of other functions that would be apparent to one of skill in the art in possession of the present disclosure. While a specific embodiment of the OLED degradation compensation system 200 is illustrated and described herein as a desktop computing system, a laptop/notebook computing system, a tablet computing system, a mobile phone, or a television, one of skill in the art in possession of the present disclosure will recognize that a wide variety of modifications to the OLED degradation compensation system 200 may be made to apply the teachings of the present disclosure to any system incorporating an OLEDs while remaining within the scope of the present disclosure.

Figure 3:
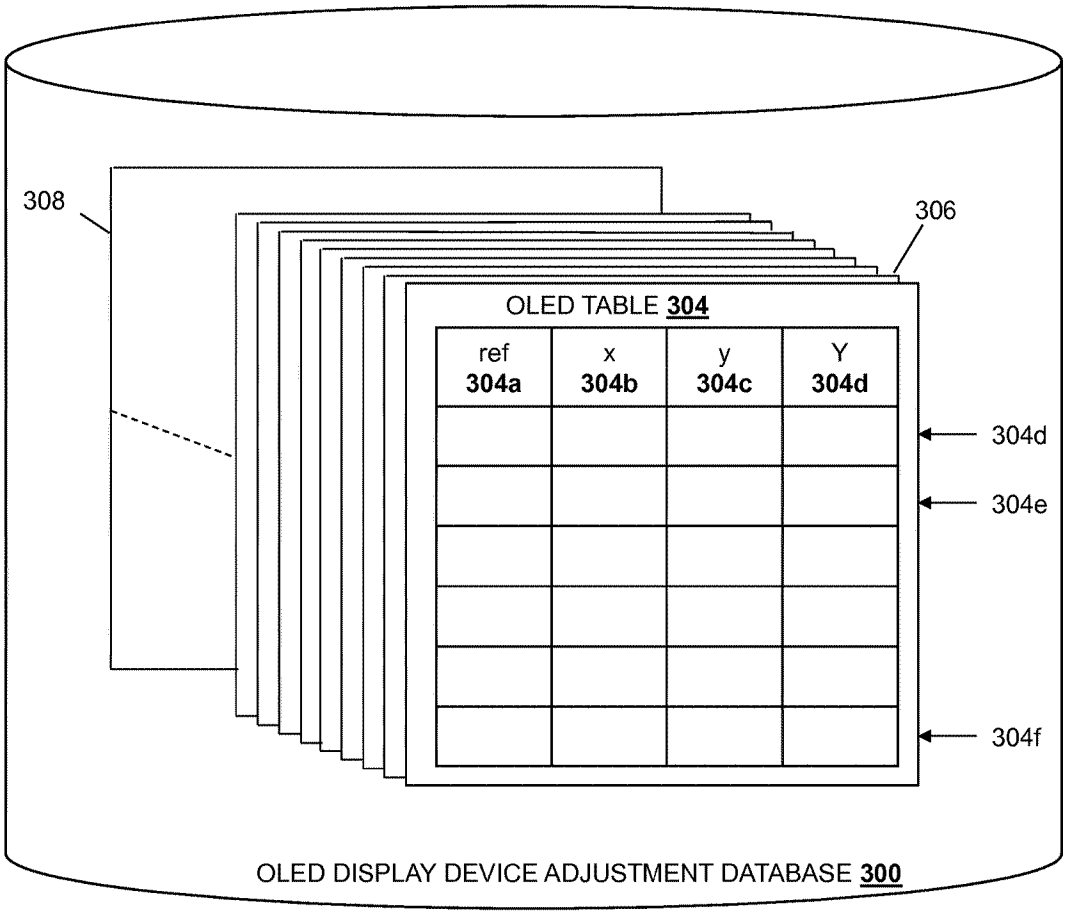
FIG. 3 is a schematic view illustrating an embodiment of an OLED display device adjustment database used in the OLED degradation compensation system of FIG. 2.

Referring now to FIG. 3, an embodiment of an OLED display device adjustment database 300 is illustrated. In an embodiment, the OLED display device adjustment database 300 may be the OLED display device adjustment database 216 discussed above with reference to FIG. 2. In the illustrated embodiment, the OLED display device adjustment database 300 includes a plurality of OLED tables 304, 306, and up to 308. However, in some embodiments, a single OLED table will fall within the scope of the present disclosure. In some embodiments, the OLED tables may be considered "three dimensional" look up tables (3D LUTs) that provide a library of colors at different decay times, as discussed below. The OLED table 304 includes OLED compensation information that, in the illustrated embodiment, is provided in a plurality of columns that includes a reference color compensation column 304*a*, an "x" color compensation column 304*b*, a "y" color compensation column 304*c*, and a "Y" bright compensation column 304*d*. For example, the OLED table 304 includes a plurality of rows 304*d*, 304*e*, and up to 304*f* that each may include reference color compensation data in the reference color compensation column 304*a*, x color compensation data in the "x" color compensation column 304*a*, a y color compensation data in the "y" color compensation column 304*b*, and Y brightness compensation data in the "Y" bright compensation column 304*c*. In an embodiment, each of the OLED tables 306 and up to 308 may be similar to the OLED table 304 discussed above, while including different color and brightness compensation data as discussed below.

Figure 4:
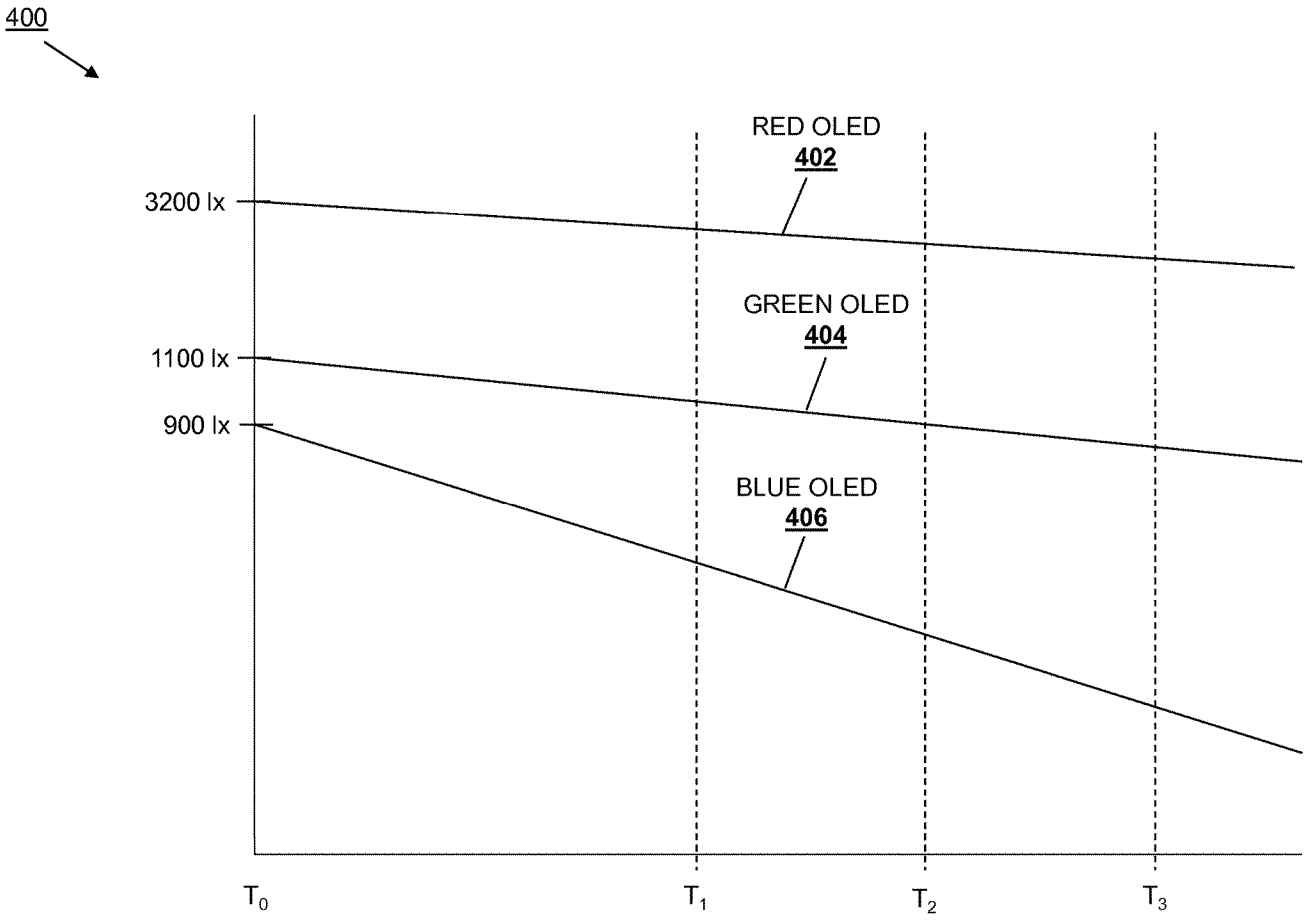
FIG. 4 is a graph view illustrating an embodiment of degradation of different color emitting OLEDs over time.

As discussed below, in some embodiments the OLED degradation compensation system 200 provides for the compensation of the degradation of OLEDs in OLED display devices by determining the amount of time OLEDs have been powered or otherwise "on", and compensating for the change in color that results from the associated time-dependent degradation of those OLEDs by powering those OLEDs based on their degradation patterns to provide for consistent color and/or brightness of the OLED display device 206 over time. For example, with reference to FIG. 4, a simplified example of the theoretical degradation of different color emitting OLEDs is illustrated. FIG. 4 provides a degradation chart 400 that tracks the theoretical degradation of the color and/or brightness of a red emitting OLED 402, a green emitting OLED 404, and a blue emitting OLED 406. The degradation chart 400 includes brightness (in lux) on the Y-axis vs. time on the X-axis (e.g., $T_1$ may be the time necessary for the OLED to lose 30% of its brightness, $T_2$ may be the time necessary for the OLED to lose 50% of its brightness, etc.) As can be seen, the degradation of the blue emitting OLED 406 is much more rapid than the degradation of the red emitting OLED and the green emitting OLED. While the degradation of the red emitting OLED 402, the green emitting OLED 404, and the blue emitting OLED 406 is illustrated as linear in the theoretic degradation chart 400, one of skill in the art in possession of the present disclosure will recognize that such OLED degradation is not linear over time, and non-linear degradation profiles for different color emitting OLEDs may be determined and utilized to provide the OLED tables while remaining within the scope of the present disclosure.

Degradation profiles for OLEDs such as those illustrated in FIG. 4 may be determined and/or utilized in providing the OLED compensation information in the OLED table(s) in the OLED display device adjustment database 300. In an embodiment, each OLED table in the OLED display device adjustment database 300 may be associated with an OLED that emits a particular color and a particular usage time for that OLED. For example, OLED table(s) may be provided for blue-emitting OLEDs at one or more particular usage times (e.g., an amount of time that blue-emitting OLED has been powered, an amount of time the OLED display device has been powered, etc.). In a specific example, the OLED table 304 may be provided for blue-emitting OLEDs in the OLED display device 206 at a usage time $T_1$, and each row in the OLED table 304 may include reference color compensation data that describes the operation of the blue-emitting OLEDs at usage time $T_0$ (i.e., no degradation), along with x and y color compensation data and Y brightness compensation data that may be used to cause the blue emitting OLEDs to produce a color/brightness at time $T_1$ that is equivalent to the color/brightness produced at time $T_0$. As such, the x and y color compensation data and Y brightness compensation data may include a variety of data that may be utilized by the OLED degradation compensation engine 212 to drive the OLEDs in the OLED display device 206 to provide for the OLED compensation functionality discussed below. Similar OLED tables (with different OLED compensation data) may be provided for the blue-emitting OLEDs at different usage times (e.g., usage times $T_2$, $T_3$, and so on), and may be provided for the red-emitting OLEDs and green emitting OLEDs as well.

In some embodiments, OLED tables may be provided for pixel colors that are provided by a combination of OLEDs. For example, an OLED table for a white color of a pixel may be provided for a pixel that produces a white color using red, green, and blue OLEDs in the OLED display device 206 at a usage time $T_1$, and each row in the OLED table 304 may include reference color compensation data that describes the operation of the red, green, and blue OLEDs for that pixel at usage time $T_0$ (i.e., no degradation), along with x and y color compensation data and Y brightness compensation data for each red, green, and blue OLED for that pixel that may be used to cause pixel to produce a white color/brightness at time $T_1$ that is equivalent to the white color/brightness produced at time $T_0$. Similar OLED tables (with different OLED compensation data) may be provided for the white color of the pixel at different usage times (e.g., usage times $T_2$, $T_3$, and so on), and may be provided for different colors of the pixel as well. While OLED tables associated with discrete usages times of the OLEDs have been described that will reduce the amount of storage necessary for those OLED tables, such discrete usage times are not meant to limit the present disclosure. For example, in systems where storage space is not limited, OLED tables may be provided for substantially continuous usage time lines to provide for granular OLED compensation as the OLED display device is used.

Figure 5:
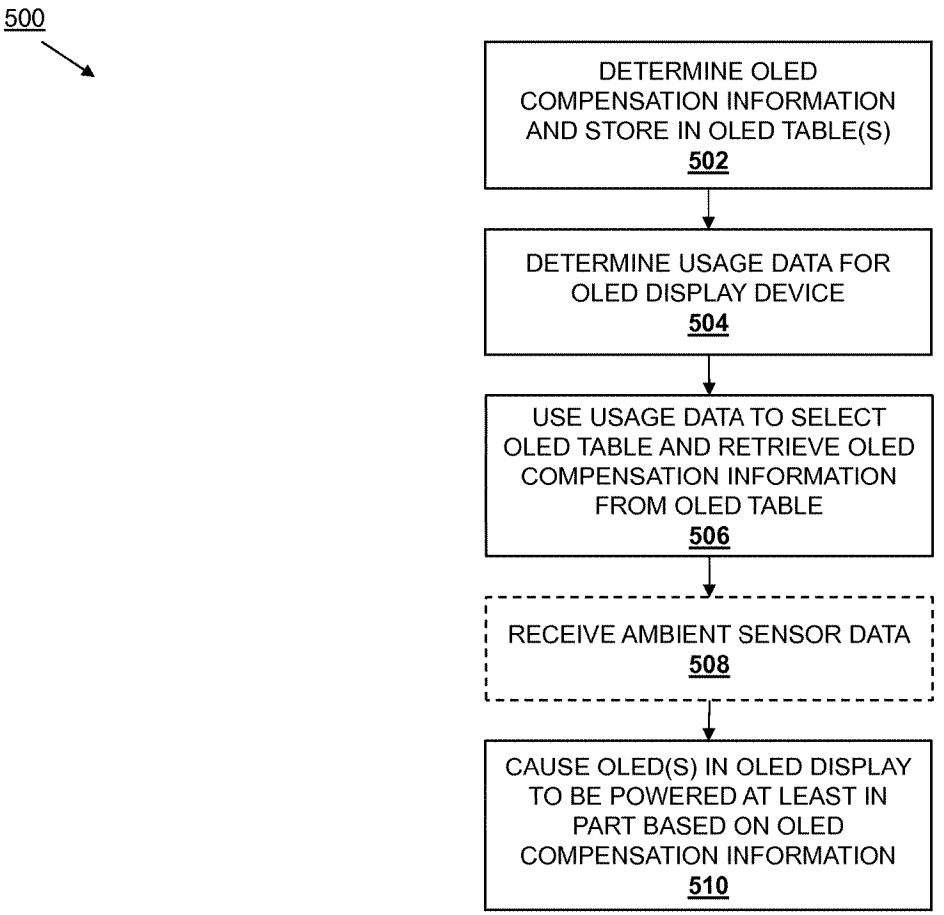
FIG. 5 is a flow chart illustrating a method for compensating for OLED degradation.

Referring now to FIG. 5, an embodiment of a method 500 for compensating for OLED degradation is illustrated. As discussed in further detail below, when an OLED display device is used, usage data for that OLED display device may be determined and used to retrieve OLED compensation information that is based upon the degradation of OLEDs in the OLED display device over time. The OLED compensation information may then be used to power the OLEDs in a manner that causes them to emit a color and/or brightness that is equivalent to the color and/or brightness they would emit without degradation. As such, the perceived display characteristics of an OLED display device may be kept consistent over time as the OLEDs in the OLED display device degrade due to use, thus providing a better user experience and a better perceived quality of the OLED display device over time.

The method 500 begins at block 502 where OLED compensation information is determined and stored in OLED tables. In some embodiments, the OLED tables in the OLED display device adjustment database 300 discussed above with reference to FIG. 3 may be determined by testing of the OLED display device 206 and providing the data that results from that testing in the OLED tables (e.g., by the OLED manufacturer, the display device manufacturer, the computing system manufacturer, etc.) For example, an optical sensor may be provided with a testing apparatus, and the OLED display device 206 may be providing in that testing apparatus and powered to allow the degradation of the OLEDs in the OLED display device 206 to be monitored over time. In some embodiments, the OLED display device 206 may be tested over its lifetime (e.g., to failure) and the data from such testing may be stored in the OLED tables in the OLED display device adjustment database 300, while in other embodiments, data from such testing may be extrapolated and the extrapolated data may be stored in the OLED tables in the OLED display device adjustment database 300.

One of skill in the art in possession of the present disclosure will recognize that compensation data to correct for the color of a pixel may include a variety of different combinations of color and/or brightness of the red, green, and blue OLEDs. For example, an increase in the current and/or voltage provided to a blue emitting OLED at a usage time $T_1$ (e.g., with no changes in the current and/or voltage provided to the red and green emitting OLEDs) may provide for a white color of the pixel that is equivalent to the white color of that pixel at time $T_0$ (i.e., when no degradation has occurred in any of the red, green, or blue emitting OLEDs), while a decrease in the current and/or voltage provided to a red emitting OLED and/or a green emitting OLED at a usage time $T_1$ (e.g., with no changes in the current and/or voltage provided to the blue emitting OLED) may provide for a white color of the pixel that is equivalent to the white color of that pixel at time $T_0$. As such, data may be provided in the OLED tables based on considerations of OLED life, desired brightness, and/or any other desired OLED display device characteristics known in the art. Furthermore, while a specific testing process for determining the OLED tables has been provided as an example, other technique for determining OLED compensation information are envisioned as falling within the scope of the present disclosure.

The method 500 then proceeds to block 504 where usage data is determined for an OLED display device. In an embodiment, the OLED display device use tracking engine 212*b* may operate at block 504 to determine usage data for the OLED display device 206. In one example, the OLED display device use tracking engine 212*b* may include a BIOS in the computing system 208, and at block 504 the BIOS may execute a BIOS script that tracks the use of the OLED display device 206 over time. In such embodiments, the BIOS may track the use of the OLED display device 206 regardless of the state of the OLED display device 206. In another example, the OLED display device use tracking engine 212*b* may include a video driver that monitors images displayed on the OLED display device 206 and tracks the use of the OLED display device 206 to display those images. While a few examples of the OLED display device use tracking engine 212*b* have been provided, one of skill in the art in possession of the present disclosure will recognize that any of a variety of subsystems may be utilized to determine the usage data for the OLED display device 206 that is utilized in the method 500 below.

In different embodiments, the usage data determined at block 504 may provide a variety of information about the OLED display device 206. For example, usage data may include an amount of time the OLED display device 206 has been powered on. As such, the OLED display device use tracking engine 212*b* may store and track a total number of seconds, minutes, hours, and/or other time variables that measure usage data that includes the time the OLED display device 206 has been powered on. In another example, usage data may include an amount of time one or more OLEDs in the OLED display device 206 have emitted light in response to being powered. As would be understood by one of skill in the art, the OLED display device 206 may be powered on without powering its OLEDs to emit light (e.g., when the OLEDs are used to provide a black color) and, as such, usage data that tracks when OLEDs are actually powered may provide a more accurate indication of OLED degradation relative to tracking of when the OLED display device 206 is powered on. However, usage data associated with the OLED display device 206 being powered on may be utilized with assumptions about how often OLEDs are powered to emit light when the OLED display device 206 is powered on in order to allow this relatively less intensive usage data tracking method to be used to estimate OLED degradation.

In embodiments in which the usage data tracks the amount of time one or more OLEDs in the OLED display device 206 are powered to emit light, the OLED display device use tracking engine 212*b* may store and track a total number of seconds, minutes, hours, and/or other time variables that measure the time any number of OLEDs have been powered to emit light as usage data. In a relatively processing and storage intensive embodiment, the OLED display device use tracking engine 212*b* may track each OLED in the OLED display device 206 each time that OLED is powered to emit light such that an amount of time each OLED has been powered to emit light is stored and updated as usage data. In a relatively less processing and storage intensive embodiment, the OLED display device use tracking engine 212*b* may track different portions of the OLED display device 206 each time the OLEDs in those different portions are powered to emit light such that an amount of time those portions of the OLED display device have been powered to emit light is stored and updated as usage data.

Figure 6:
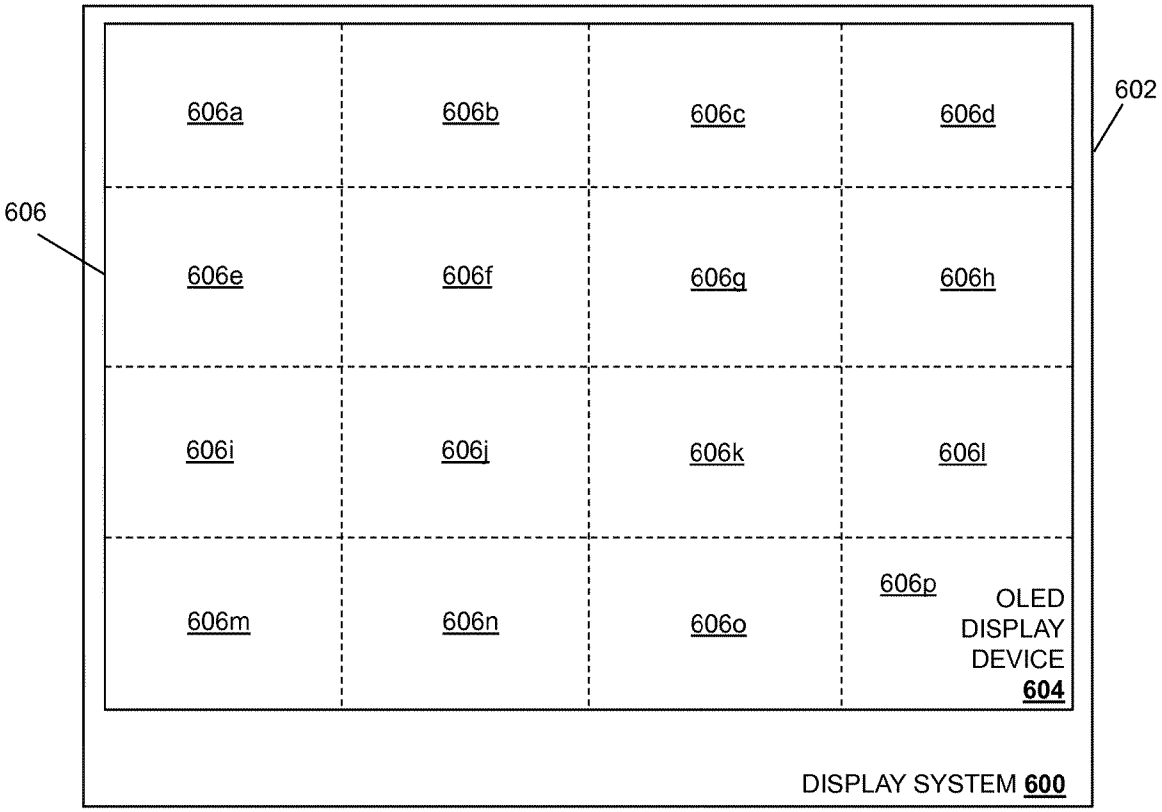
FIG. 6 is a schematic view illustrating an embodiment of OLED display device screen portions.

For example, with reference to FIG. 6, an embodiment of a display system 600 that includes a chassis 602 with an OLED display device 604 is illustrated that may be the display system 202, chassis 204, and OLED display device 206 of FIG. 2. The OLED display device 604 includes a screen 606 having a plurality of different screen portions 606*a-p*. In an embodiment of block 504, the OLED display device use tracking engine 212*b* may track when each of the portions 606*a-p* of the screen 606 emit light such that an amount of time that each portion 606*a-p* has emitted light is stored and updated as usage data. In some embodiments, a portion 606*a-p* of the screen 606 may be considered to be powered to emit light when a majority of the OLEDs providing that portion are powered to emit light, although fewer or more OLEDs in a portion 606*a-p* being powered to emit light may cause the portion to be considered powered to emit light as well. In some embodiments, the color of light emitted by the portions 606*a-p* (i.e., by particular colored OLEDs in those portions) may be tracked as the usage data at block 504. For example, a video driver providing the OLED display device use tracking engine 212*b* may track images provided for display on the OLED display device 604, and may monitor and store the colors provided in those images in the different portions 606*a-p* of the screen 606 as usage data that is indicative of the powering and emission of light from particular OLEDs (e.g., red, green, and/or blue emitting OLEDs) in those portions. While a few examples have been provided, one of skill in the art in possession of the present disclosure will recognize that the tacking of the use of the OLEDs in the different portions 606*a-p* of the screen 606 may be performed in a variety of manners that will fall within the scope of the present disclosure.

In a relatively less processing and storage intensive embodiment than those already described above, the OLED display device use tracking engine 212*b* may track the entire screen 606 of the OLED display device 604 in a similar manner as described for any of the portions 606*a-p* above. Furthermore, one of skill in the art in possession of the present disclosure will recognize that the screen 606 of the OLED display device 604 may include more or fewer portions than illustrated in FIG. 6 depending on the level of processing and storage available for the OLED degradation compensation system.

The method 500 then proceeds to block 506 where the usage data is used to select an OLED table and retrieve OLED compensation information from that OLED table. In an embodiment, at block 506, the OLED display device adjustment engine 212*a* may receive or retrieve the usage data determined at block 504 by the OLED display device use tracking engine 212*b*. For example, as discussed above, a BIOS or video driver operating as the OLED display device use tracking engine 212*b* may continuously or periodically determine the usage data for the OLED display device 206, and a GPU operating as the OLED display device adjustment engine 212*a* may continuously or periodically receive or retrieve that usage data from the OLED display device use tracking engine (e.g., upon powering of the OLED display device 206, the computing system 208, and/or in response to any of a variety of initialization scenarios known in the art; at predefined time periods during use of the OLED display device 206 and/or the computing system 208; etc.)

As discussed above with reference to FIG. 4, at a usage time $T_0$, each of the OLEDs in the OLED display device 206 may emit light at a desired color/brightness in response to a predefined current and/or voltage, while at a usage time $T_1$, each of the OLEDs in the OLED display device 206 may emit light at less than the desired color/brightness in response to the predefined current and/or voltage (i.e., due to OLED degradation). In some embodiments, at times between the usage time $T_0$ and the usage time $T_1$, the OLED display device adjustment engine 212*a* may be configured to not attempt to compensate for the degradation of OLEDs in the OLED display device 206 (e.g., due to that degradation being considered not sever enough to require compensation). As such, in those embodiments, if the usage data determined at block 504 indicates a usage time of the OLED display device 206 that is less than the usage time $T_1$, the OLED display device adjustment engine 212*a* may continue to provide the predetermined current and/or voltage to each of the OLEDs in the OLED display device 206 when those OLEDs are needed to emit light. However, in those embodiments, if the usage data determined at block 504 indicates a usage time of the OLED display device 206 that is greater than or equal to the usage time $T_1$, the OLED display device adjustment engine 212*a* may access the OLED display device adjustment database 216 and determine one or more OLED tables that re associated with the usage data/usage time $T_1$. One of skill in the art in possession of the present disclosure will recognize that the time periods between the times that cause the OLED display device adjustment engine 212*a* to determine an OLED table may be selected to regularly or continuously compensate for degradation of OLEDs as they degrade (i.e., when storage for the OLED tables is not an issue), or to only compensate for degradation of OLEDs at discrete times (e.g., every 500 hours when storage for the OLED tables may be an issue.)

With reference to FIG. 3, at block 506 the OLED display device adjustment engine 212*a* may access the OLED display device adjustment database 216/300 and, using the usage data, retrieve at least one of the OLED tables 304, 306, and up to 308. In an embodiment, as discussed above, the usage data determined at block 504 may be associated with some time period of use of the OLED display device 206, the screen of the OLED display device 206, portions of the screen of the OLED display device 206, pixels in the OLED display device 206, OLEDs in the OLED display device 206, and/or other sub-divisions of the OLED display device 206. At block 506, the OLED display device adjustment engine 212*a* uses the usage data (e.g., a OLED display device/device sub-division usage time) to retrieve any OLED tables associated with a usage time that corresponds to that usage data. For example, the usage data may indicate a time of 500 hours, and at block 506 the OLED display device adjustment engine 212*a* may use that usage data to retrieve OLED tables for red, green, and/or blue emitting OLEDs that have been powered for at least 500 hours, OLED tables for pixel(s) that have been powered for at least 500 hours, OLED tables for screen portions that have powered for at least 500 hours, OLED tables for a screen that has powered for at least 500 hours, etc.

Using the retrieved OLED tables, the OLED display device adjustment engine 212*a* may then retrieve OLED compensation information. In an embodiment, the OLED display device adjustment engine 212*a* may utilize reference colors (e.g., desired colors and/or brightness to be emitted by OLEDs in the OLED display device 206) with the OLED tables selected at block 506 to determine a rows in those OLED tables and retrieve OLED compensation information that may include x color compensation data in the "x" color compensation column 304*a* for determined rows, y color compensation data in the "y" color compensation column 304*b* for the determined rows, and Y brightness compensation data in the "Y" bright compensation column 304*c* for the determined rows. In a specific example, the OLED table 304 for a white color of a pixel may be selected using the usage data, the reference color may be a particular color and brightness value for a white color, and that reference color may correspond to reference color compensation data in the reference color compensation column 304*a* of row 304*d*. The OLED display device adjustment engine 212*a* may then retrieve x color compensation data in the "x" color compensation column 304*a* for row 304*d*, *y* color compensation data in the "y" color compensation column 304*b* for row 304*d*, and Y brightness compensation data in the "Y" bright compensation column 304*c* for row 304*d*. As discussed above, that OLED compensation data may provide current, voltage, powering, and/or other OLED driving information that is configured to produce a perceived white color of the pixel using the OLEDs that have degraded that is equivalent to the white color that would be produced with no degradation in those OLEDs. One of skill in the art in possession of the present disclosure will recognize how OLED tables for different sub-divisions of the OLED display device 206 may be utilized in a similar manner to determine OLED compensation information while remaining within the scope of the present disclosure.

The method 500 may then proceed to optional block 508 where ambient sensor data is received. In an embodiment, the OLED display device adjustment engine 212*a* may receive ambient sensor data from the ambient sensors 218. For example, as discussed above, the ambient sensor(s) 218 may include light sensors, and at optional block 508 the OLED display device adjustment engine 212*a* may receive ambient sensor data that includes ambient light conditions and/or other ambient light data known in the art. In another example, as discussed above, the ambient sensor(s) 218 may include cameras, and at optional block 508 the OLED display device adjustment engine 212*a* may receive images and/or a variety of other camera data known in the art. In an embodiment, optional block 508 may include the OLED display device adjustment engine 212*a* analyzing the ambient sensor data to determination a variety of information. For example, the light sensor data (e.g., ambient light conditions) may be analyzed to determine OLED adjustment information that may be used to adjust the output of the OLEDs in the OLED display device 206. In another example, the camera data (e.g., images and/or video of the user using the OLED display device) may be analyzed to determine user characteristics (e.g., user location, user eye location and directionality, etc.) that may be used to adjust the output of the OLEDs in the OLED display device 206. While a few examples have been provided, one of skill in the art in possession of the present disclosure will recognize that any of a variety of ambient sensor data may be received and analyzed to determine OLED adjustment information while remaining within the scope of the present disclosure.

The method 500 then proceeds to block 510 where the OLEDs are caused to be powered at least in part using the OLED compensation information. In some embodiments, the OLED display device adjustment engine 212*a* may use the OLED compensation information retrieved at block 506 to cause the OLEDs in the OLED display device 206 to be powered at a level (e.g., via a current and/or voltage) that compensates for degradation of the OLEDs, while in some embodiments, the OLED display device adjustment engine 212*a* may also use the OLED adjustment information determined at block 508 to cause the OLEDs in the OLED display device 206 to be powered. For example, the OLED display device adjustment engine 212*a* may send an instruction that causes any or all of the OLEDs in the OLED display device 206 to be powered at a level to compensate for the OLED degradation based on the OLED compensation information and, in some embodiments, the OLED adjustment information. In a specific example, the OLED display device adjustment engine 212*a* may send an instruction (e.g., via an Advanced Configuration and Power Interface (ACPI), a mail box, etc.) to set a flag in software or hardware (e.g., in an eeColor subsystem and/or algorithm) to apply the OLED compensation information and OLED adjustment information to the OLED display device 206. While specific OLED compensation information and OLED adjustment information has been described above, other inputs may be provided to the OLED display device adjustment engine 212*a* including, for example, instructions to compensate for OLEDs of a particular color (e.g., blue emitting OLEDs), pixel shifting matrices, circadian times, and/or other display adjustment instructions known in the art.

As such, one or more of the OLEDs in the OLED display device 206 may be powered at a level that is based on the OLED compensation information, each of the OLEDs in one or more pixels of the OLED display device 206 may be powered at a level that is based on the OLED compensation information, each of the OLEDs in the screen of the OLED display device 206 may be powered at a level that is based on the OLED compensation information, each of the OLEDs in a particular portion of the screen of the OLED display device 206 may be powered at a level that is based on the OLED compensation information, etc. One of skill in the art in possession of the present disclosure will recognize how the OLED adjustment information (i.e., determined from the ambient sensor data) may be used to power the OLEDs as well. For example, those OLEDs may be powered based on the ambient light conditions, the portions of the screen a user is looking at (e.g., based on a detected eye directionality), etc.

Thus, systems and methods have been described that track the usage of an OLED display device in order to be able to retrieve OLED compensation information that is then used to compensate for the degradation of OLEDs in the OLED display device over time. The OLED compensation information allows for the powering of the OLEDs in a manner that causes them to emit a color and/or brightness that is equivalent to the color and/or brightness they would emit without degradation. As is known in the art, as an OLED degrades its brightness output decreases, and when the brightness of a primary color decreases, colors created using that primary color appear less saturated/vivid. As such, the degradation of any primary color OLEDs will impact all display colors as those primary color OLEDs are mixed. The systems and methods of the present disclosure maintain primary color brightness at an original preset such that color output and color mixing will not be impacted, resulting in the perceived display characteristics of an OLED display device being kept consistent over time as the OLEDs in the OLED display device degrade due to use, thus providing a better user experience and a better perceived quality of the OLED display device over time. While the discussions above have focused on compensating for the degradation of OLEDs in OLED display devices, one of skill in the art in possession of the present disclosure will recognize how the techniques discussed herein will be beneficial to a variety of different display devices having a display technologies that include degradable display components such as, for example, discrete LED display devices, phosphor display devices, and/or other display devices known in the art.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An Organic Light Emitting Diode (OLED) degradation compensation system, comprising:

a display system;

an OLED display device included on the display system, wherein the OLED display device includes a first color OLED and a second color OLED that is a different color than the first color OLED; and a computing device coupled to the display system, wherein the computing device includes:

an OLED display device adjustment database storing:

a first OLED table that is identifiable by a first usage time period and the first color OLED, and that includes first OLED compensation information that is configured to compensate for OLED degradation that has occurred to the first color OLED over that first usage time period, and a second OLED table that is identifiable by a second usage time period and the second color OLED, and that includes second OLED compensation information that is configured to compensate for OLED degradation that has occurred to the second color OLED over that second usage time period, wherein the first OLED compensation information is different than the second OLED compensation information when the first usage time period and the second usage time period are the same;

an OLED display device use tracking engine that is configured to determine first usage data for the first color OLED; and an OLED display device adjustment engine that is configured to retrieve the first usage data determined by the OLED display device use tracking engine, use the first usage data to determine a first usage time for that first color OLED, select the first OLED table in response to the first usage time corresponding to the first usage time period identifying the first OLED table, and cause the first color OLED in the OLED display device to be powered using the first OLED compensation information in the first OLED table.

2. The OLED degradation compensation system of claim 1, further comprising:

at least one ambient sensor, wherein the OLED display device adjustment engine is configured to receive ambient sensor data from the at least one ambient sensor and cause the first color OLED in the OLED display device to be powered based on the ambient sensor data.

3. The OLED degradation compensation system of claim 1, wherein the OLED display device use tracking engine that is configured to determine usage data for the OLED display device includes a basic input/output system (BIOS) that executes a BIOS script that tracks the use of the first color OLED over time to obtain the first usage data.

4. The OLED degradation compensation system of claim 1, wherein the OLED display device use tracking engine is configured to determine second usage data for the second color OLED, and wherein the OLED display device adjustment engine is configured to retrieve the second usage data determined by the OLED display device use tracking engine, use the second usage data to determine a second usage time for that second color OLED, select the second OLED table in response to the second usage time corresponding to the second usage time period identifying the second OLED table, and cause the second color OLED in the OLED display device to be powered using the second OLED compensation information in the first OLED table.

5. The OLED degradation compensation system of claim 1, wherein the first OLED compensation information in the first OLED table includes at least one color value and a brightness value.

6. The OLED degradation compensation system of claim 1, wherein the first usage data for the first color OLED includes an amount of time the first color OLED in the OLED display device has been powered.

7. An information handling system (IHS), comprising:

a display device connector that is configured to couple to an Organic Light Emitting Diode (OLED) display device, wherein the OLED display device includes a first color OLED and a second color OLED that is a different color than the first color OLED;

a storage system storing:

a first OLED table that is identifiable by a first usage time period and the first color OLED, and that includes first OLED compensation information that is configured to compensate for OLED degradation that has occurred to the first color OLED over that first usage time period, and a second OLED table that is identifiable by a second usage time period and the second color OLED, and that includes second OLED compensation information that is configured to compensate for OLED degradation that has occurred to the second color OLED over that second usage time period, wherein the first OLED compensation information is different than the second OLED compensation information when the first usage time period and the second usage time period are the same;

a processing system coupled to the storage system and the display device connector; and a memory system coupling to the processing system and including instructions that, when executed by the processing system, cause the processing system to provide an OLED degradation compensation engine that is configured to:

determine first usage data for the first color OLED;

determine a first usage time for the first color OLED that is based on the first usage data;

select the first OLED table in the storage system in response to the first usage time corresponding to the first usage time period that identifies the first OLED table; and cause the first color OLED to be powered using the first OLED compensation information in the first OLED table.

8. The IHS of claim 7, further comprising:

at least one ambient sensor coupled to the processing system, wherein the OLED degradation compensation engine is configured to receive ambient sensor data from the at least one ambient sensor and cause the first color OLED in the OLED display device to be powered based on the ambient sensor data.

9. The IHS of claim 7, wherein the OLED degradation compensation engine includes a basic input/output system (BIOS) that executes a BIOS script that tracks the use of the first color OLED over time to obtain the first usage data.

10. The IHS of claim 7, wherein the OLED degradation compensation engine is configured to:

determine second usage data for the second color OLED;

determine a second usage time for the second color OLED that is based on the second usage data:

select the second OLED table in the storage system in response to the second usage time corresponding to the second usage time period that identifies the second OLED table; and cause the second color OLED to be powered using the second OLED compensation information in the second OLED table.

11. The IHS of claim 7, wherein the first OLED compensation information in the first OLED table includes at least one color value and a brightness value.

12. The IHS of claim 7, wherein the first usage data for the first color OLED includes an amount of time the first color OLED in the OLED display device has been powered.

13. The IHS of claim 7, wherein the OLED display device includes a first screen portion and a second screen portion that is different than the first screen portion, and wherein the causing the first color OLED in the OLED display device to be powered using the first OLED compensation information includes causing at least one first color OLED that is located in the first screen portion to be powered using the first OLED compensation information while first color OLEDs located in the second screen portion are powered without using the first OLED compensation information.

14. A method for compensating for Organic Light Emitting Diode (OLED) degradation, comprising:

determining, by an OLED degradation compensation system, first usage data for a first color OLED included on an OLED display device that includes a second color OLED that is a different color than the first color OLED;

determining, by the OLED degradation compensation system, a first usage time for the first color OLED using the first usage data;

selecting, by the OLED degradation compensation system, a first OLED table for first color OLEDs that is stored in an OLED display device adjustment database in response to the first usage time corresponding to a first usage time period that identifies the first OLED table, wherein the OLED display device adjustment database includes a second OLED table that is identifiable by a second usage time period and the second color OLED, and that includes second OLED compensation information that is configured to compensate for OLED degradation that has occurred to the second color OLED over that second usage time period, and wherein first OLED compensation information of the first OLED table is different than the second OLED compensation information when the first usage time period and the second usage time period are the same; and causing, by the OLED degradation compensation system, the first color OLED to be powered using the first OLED compensation information that is included in the first OLED table and that is configured to compensate for first color OLED degradation that occurred in the first color OLED over the first usage time period.

15. The method of claim 14, further comprising:

receiving, by the OLED degradation compensation system, ambient sensor data from at least one ambient sensor and causing the first color OLED in the OLED display device to be powered based on the ambient sensor data.

16. The method of claim 14, further comprising:

tracking by a basic input/output system (BIOS) included in the OLED degradation compensation system, the use of the first color OLED over time to obtain the first usage data.

17. The method of claim 14, further comprising:

determining, by the OLED degradation compensation system, second usage data for the second color OLED;

determining, by the OLED degradation compensation system, a second usage time for the second color OLED using the second usage data;

selecting, by the OLED degradation compensation system, the second OLED table for second color OLEDs that is stored in the OLED display device adjustment database in response to the second usage time corresponding to a second usage time period that identifies the second OLED table; and causing, by the OLED degradation compensation system, the second color OLED to be powered using second OLED compensation information that is included in the second OLED table and that is configured to compensate for second color OLED degradation that occurred in the second color OLED over the second usage time period.

18. The method of claim 14, wherein the first OLED compensation information in the first OLED table includes at least one color value and a brightness value.

19. The method of claim 14, wherein the first usage data for the first color OLED includes an amount of time the first color OLED in the OLED display device has been powered.

20. The method of claim 14, wherein the OLED display device includes a first screen portion and a second screen portion that is different than the first screen portion, and wherein the causing at the first color OLED in the OLED display device to be powered using the first OLED compensation information includes causing at least one first color OLED that is located in the first screen portion to be powered using the first OLED compensation information while first color OLEDs located in the second screen portion are powered without using the first OLED compensation information.

* * * * *